US011056781B2

(12) United States Patent
Zhang et al.

(10) Patent No.: US 11,056,781 B2
(45) Date of Patent: Jul. 6, 2021

(54) ANTENNA AND MOBILE TERMINAL

(71) Applicant: HUAWEI TECHNOLOGIES CO., LTD., Guangdong (CN)

(72) Inventors: Ming Zhang, Hangzhou (CN); Daqing Liu, Hangzhou (CN); Huailin Wen, Ottawa (CA)

(73) Assignee: HUAWEI TECHNOLOGIES CO., LTD., Guangdong (CN)

( * ) Notice: Subject to any disclaimer, the term of this patent is extended or adjusted under 35 U.S.C. 154(b) by 205 days.

(21) Appl. No.: 16/250,784

(22) Filed: Jan. 17, 2019

(65) Prior Publication Data

US 2019/0157751 A1 May 23, 2019

Related U.S. Application Data

(63) Continuation of application No. PCT/CN2017/090324, filed on Jun. 27, 2017.

(30) Foreign Application Priority Data

Jul. 20, 2016 (CN) ..... 201610578153.3

(51) Int. Cl.

| | |
|---|---|
| ***H01Q 1/52*** | (2006.01) |
| ***H01Q 1/24*** | (2006.01) |
| ***H01Q 1/48*** | (2006.01) |

(52) U.S. Cl.

CPC ..... *H01Q 1/52* (2013.01); *H01Q 1/243* (2013.01); *H01Q 1/48* (2013.01); *H01Q 1/521* (2013.01)

(58) Field of Classification Search

CPC ..... H01Q 1/243; H01Q 1/48; H01Q 1/52; H01Q 1/521; H01Q 1/523; H01Q 25/00; H01Q 25/001; H01Q 25/004; H01Q 25/005; H01Q 21/205; H01Q 21/24; H01Q 21/29

See application file for complete search history.

(56) References Cited

U.S. PATENT DOCUMENTS

| | | | | |
|---|---|---|---|---|
| 10,707,579 | B2 * | 7/2020 | Krogerus | H01Q 21/28 |
| 2009/0135077 | A1 | 5/2009 | Kim et al. | |
| 2012/0194391 | A1 | 8/2012 | Liu et al. | |

(Continued)

FOREIGN PATENT DOCUMENTS

| | | | |
|---|---|---|---|
| CN | 101807748 | A | 8/2010 |
| CN | 201838715 | U | 5/2011 |

(Continued)

*Primary Examiner* — Dimary S Lopez Cruz
*Assistant Examiner* — Patrick R Holecek
(74) *Attorney, Agent, or Firm* — Womble Bond Dickinson (US) LLP

(57) ABSTRACT

The application disclose an antenna. The antenna includes a first radiating element, a second radiating element, a third radiating element, and a closed ring, where the first radiating element is connected to a first feed point, the second radiating element is connected to a second feed point, and the third radiating element is connected to a third feed point; the closed ring is configured to be disposed in a clearance area of a ground plate, and configured to connect to the ground plate; the first radiating element, the second radiating element, and the third radiating element are connected by using a microstrip, to form a radiator; the third radiating element is disposed between the first radiating element and the second radiating element.

10 Claims, 14 Drawing Sheets

(56) References Cited

U.S. PATENT DOCUMENTS

| | | | |
|---|---|---|---|
| 2013/0201074 | A1 | 8/2013 | Harper et al. |
| 2014/0159971 | A1 | 6/2014 | Hall et al. |
| 2014/0225784 | A1 | 8/2014 | Li et al. |
| 2015/0048991 | A1 | 2/2015 | Pajona et al. |

FOREIGN PATENT DOCUMENTS

| | | | |
|---|---|---|---|
| CN | 202275941 | U | 6/2012 |
| CN | 103138053 | A | 6/2013 |
| CN | 103155281 | A | 6/2013 |
| CN | 103268987 | A | 8/2013 |
| CN | 103811869 | A | 5/2014 |
| CN | 204375977 | U | 6/2015 |

* cited by examiner

ANTENNA AND MOBILE TERMINAL

CROSS-REFERENCE TO RELATED APPLICATIONS

This application is a continuation of International Application No. PCT/CN2017/090324, filed on Jun. 27, 2017, which claims priority to Chinese Patent Application No. 201610578153.3, filed on Jul. 20, 2016. The disclosures of the aforementioned applications are hereby incorporated by reference in their entireties.

TECHNICAL FIELD

This application relates to the field of antenna technologies, and in particular, to an antenna applied to a mobile terminal and a mobile terminal using the antenna.

BACKGROUND

With rapid development of a mobile communications system, an antenna, as a key component, plays an irreplaceable role in the mobile communications system. Nowadays, antenna technologies have been experiencing great changes, and an existing MIMO (Multiple-input and Multiple-output) antenna technology is a core technology in wireless communications technologies. The MIMO technology may be simply defined as follows: In a wireless communications system, a signal transmit end and a signal receive end each use a plurality of antenna elements. The MIMO technology allows establishment of parallel signal transmission paths, thereby improving a system capacity. If an antenna size is not restricted, a system throughput linearly increases with a quantity of antennas. However, for a terminal device, the antenna size is strictly limited. When a plurality of antennas are disposed inside the terminal, strong mutual coupling is caused, and performance of a MIMO antenna is reduced.

Based on an existing terminal antenna design, if coupling between antenna elements is reduced, relatively large space is occupied by an antenna. If a size of the antenna is reduced, coupling between the antenna elements is quite strong. Therefore, how to implement decoupling and use existing antenna space more effectively is a problem to be resolved urgently for the MIMO antenna.

SUMMARY

Embodiments of this application provide an antenna. The antenna can improve isolation between all radiating elements and reduce a coupling degree. In addition, a structure design of the antenna makes full use of a clearance area of a ground plate, thereby effectively reducing an antenna size.

According to a first aspect, this application provides an antenna, including a first radiating element, a second radiating element, a third radiating element, and a closed ring. The first radiating element is connected to a first feed point, the second radiating element is connected to a second feed point, and the third radiating element is connected to a third feed point. The closed ring is configured to be disposed in a clearance area of a ground plate, and configured to connect to the ground plate. The first radiating element, the second radiating element, and the third radiating element are connected using a microstrip, to form a radiator, and the radiator is excited by the first feed point, the second feed point, and the third feed point. The third radiating element is disposed between the first radiating element and the second radiating element. The first radiating element is disposed on a first side of the closed ring, the second radiating element is disposed on a second side of the closed ring, and the second side is opposite to or symmetric with the first side. Two sides of the closed ring participate in radiation of the first radiating element and the second radiating element. To be specific, the first side participates in radiation of the first radiating element, and the second side participates in radiation of the second radiating element. A main radiation direction of the first radiating element is a first direction, a main radiation direction of the second radiating element is a second direction, and the first direction is opposite to the second direction. A first preset distance is set between the first radiating element and the third radiating element, and a second preset distance is set between the third radiating element and the second radiating element. A polarization manner of the first radiating element is the same as a polarization manner of the second radiating element, and a polarization manner of the third radiating element is orthogonal to the polarization manners of the first radiating element and the second radiating element.

In one embodiment, the first radiating element, the second radiating element, and the third radiating element are connected using the microstrip, so that the first radiating element, the second radiating element, and the third radiating element form one entity, and the first radiating element, the second radiating element, and the third radiating element are all disposed on the closed ring. Such an antenna design delivers a compact structure and makes full use of the clearance area of the ground plate. Two sides of the closed ring participate in radiation of the first radiating element and radiation of the second radiating element, respectively, the main radiation direction of the first radiating element is opposite to the main radiation direction of the second radiating element, and there is good radiation pattern diversity in the first radiation direction and the second radiation direction, reducing a degree of coupling between the first radiating element and the second radiating element. The first preset distance and the second preset distance participate in radiation of the third radiating element, so that the polarization manner of the third radiating element is orthogonal to the polarization manners of the first radiating element and the second radiating element, and polarization diversity of the first radiating element, the second radiating element, and the third radiating element is used, to effectively reduce degrees of coupling between the third radiating element and the first radiating element and between the third radiating element and the second radiating element, and improve isolation.

In one embodiment, the first preset distance is equal to the second preset distance, ensuring that the polarization manners are pure. The first preset distance and the second preset distance may range from 0.1 mm to 3 mm.

In one embodiment, a length of the antenna is $$\frac{1}{4}\lambda, \text{ where } \lambda = \frac{v}{f_0},$$

v is a speed of light, and $f_0$ is a lowest frequency of an operating band of the antenna. For example, the lowest frequency of the operating band of the antenna is 3.85 GHz. In this case, the length of the antenna is 19.48 mm. In this embodiment of this application, such an antenna structure design effectively reduces the size of the antenna.

In one embodiment, a radiation band of the third radiating element can be adjusted using an adjustable network, and an adjustment range of the frequency band of the third radiating element falls within a range of a frequency band of the first radiating element or the second radiating element. Because different operating bands are allocated to various wireless communication systems, to ensure that a communications device can operate in a plurality of systems, the operating band of the antenna is this embodiment of this application may cover these frequency bands, and the antenna occupies as small space as possible.

In one embodiment, the closed ring is of a rectangular shape. Specifically, the shape may be of a "口", "日", "冂", or "冂" shape. For example, a closed ring of the "日" shape includes a left vertical side and a right vertical side that are symmetric, and the two symmetric vertical sides are a first side and a second side, respectively. The two sides participate in radiation of the first radiating element and radiation of the second radiating element, respectively. In this embodiment of this application, the rectangular closed ring allows the first radiating element and the second radiating element to obtain a better pattern diversity effect. Such an antenna design delivers a compact structure and makes full use of space of the clearance area of the ground plate.

According to a second aspect, this application provides a mobile terminal. The mobile terminal includes a ground plate, a transceiver, and the antenna in the first aspect. The antenna includes a first radiating element, a second radiating element, a third radiating element, and a closed ring. The first radiating element is connected to a first feed point, the second radiating element is connected to a second feed point, and the third radiating element is connected to a third feed point. The closed ring is configured to be disposed in a clearance area of the ground plate, and configured to connect to the ground plate. The first radiating element, the second radiating element, and the third radiating element are connected using a microstrip, to form a radiator, and the radiator is excited by the first feed point, the second feed point, and the third feed point. The third radiating element is disposed between the first radiating element and the second radiating element. The first radiating element is disposed on a first side of the closed ring, the second radiating element is disposed on a second side of the closed ring, and the second side is opposite to the first side. A first preset distance is set between the first radiating element and the third radiating element, and a second preset distance is set between the third radiating element and the second radiating element. The first feed point, the second feed point, and the third feed point are all connected to the transceiver. In this embodiment of this application, the antenna has a miniaturized structure and high isolation performance, so that signal transceiving performance of the mobile terminal is effectively improved.

DESCRIPTION OF EMBODIMENTS

Embodiments of this application provide an antenna and a mobile terminal. The mobile terminal is configured to provide an antenna. The antenna includes a first radiating element, a second radiating element, and a third radiating element. The antenna greatly improves isolation between all radiating elements through radiation pattern diversity and polarization diversity. In addition, a compact design of the antenna makes full use of a clearance area of a ground plate, thereby effectively reducing an antenna size.

To make a person skilled in the art understand the technical solutions in this application better, the following clearly and completely describes the technical solutions in the embodiments of this application with reference to the accompanying drawings in the embodiments of this application. Apparently, the described embodiments are merely some but not all of the embodiments of this application. All other embodiments obtained by a person of ordinary skill in the art based on the embodiments of this application without creative efforts shall fall within the protection scope of this application.

Terms "first", "second", "third", "fourth", and the like (if existent) in the specification, claims, and accompanying drawings of this application are intended to distinguish between similar objects, but do not necessarily indicate a specific order or sequence. It should be understood that data used in such a way are interchangeable in proper circumstances so that the embodiments described herein can be implemented in other orders than the order illustrated or described herein. In addition, terms "include", "have", and any variations thereof are intended to cover non-exclusive inclusion. For example, a process, method, system, product, or device that includes a series of steps or units is not necessarily limited to the explicitly listed steps or units, but may include another step or unit that is not explicitly listed or that is inherent to the process, method, product, or device.

For ease of understanding, some terms in the embodiments of this application are first explained.

A multiple-input multiple-output (Multiple-input Multiple-output, MIMO for short) technology means that a signal transmit end and a signal receive end each include a plurality of radiating elements. If the radiating elements are extremely far from each other, the radiating elements are loosely correlated. However, in a mobile terminal such as a mobile phone, due to relatively small space, the radiating elements definitely do not work independently, but strong electromagnetic coupling is generated between the radiating elements.

Figure 1:
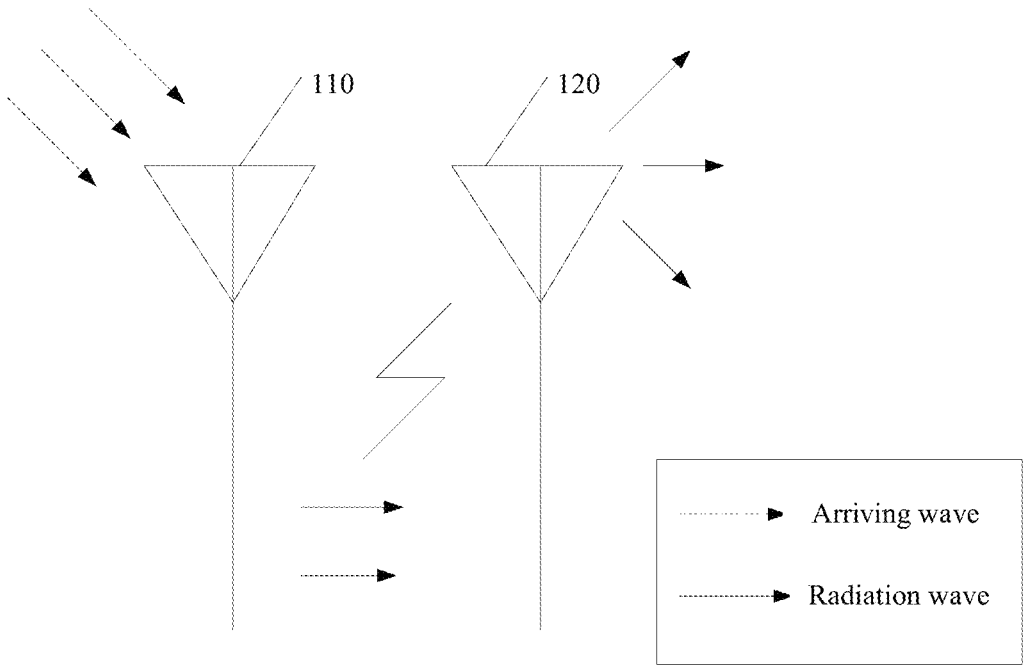
FIG. 1 is a schematic diagram of antenna coupling.

The coupling can be understood as follows: When two or more radiating elements are arranged in free space, a radiating element is subject not only to an electromagnetic effect generated by a current of the radiating element, but also to an electromagnetic effect generated by a current of another radiating element. Particularly, when radiating elements are getting closer to each other, a complex mutual effect is generated between the radiating elements. Such a mutual effect is referred to as mutual coupling. Refer to FIG. 1 for understanding. FIG. 1 is a schematic diagram of coupling generated when two radiating elements are arranged. A first radiating element 110 and a second radiating element 120 both receive an arriving wave from free space. Due to a characteristic of an antenna, when the first radiating element 110 receives an arriving wave, the first radiating element 110 also serves as a source to generate excitation and radiate some energy. Therefore, a signal received by the second radiating element 120 further includes a radiation wave radiated by the first radiating element 110, in addition to the arriving wave from the space. Likewise, the second radiating element generates an induced current that reacts on the first radiating element 110. The second radiating element and the first radiating element affect each other. This is a mutual coupling effect. Because there is electromagnetic induction (a mutual coupling effect) between the radiating elements, a current of each radiating element changes, and current distribution is different from that present when each radiating element is disposed in free space. Therefore, antenna performance is seriously affected.

Isolation: The isolation indicates a degree of mutual independence between radiating elements. A lower degree of coupling between the radiating elements indicates a higher isolation; in turn, a higher degree of coupling between antenna elements indicates a lower isolation. For example, in actual application, an isolation of 15 dB can meet an engineering requirement.

Radiation pattern diversity: Power radiated by a radiation unit is usually distributed unevenly in different directions in space. In other words, an antenna has directivity. A radiation pattern is a function graph between a radiation characteristic and space coordinates of an antenna, and is a graphic description of antenna directivity. Therefore, the radiation pattern diversity may be used to analyze a radiation characteristic of a radiating element.

Polarization diversity: Two signals from one signal source are carried by radio waves of a radiating element in different polarization directions, for example, a vertical polarization direction and a horizontal polarization direction. The two signals are mutually independent and not correlated with each other, and have different attenuation characteristics, achieving a polarization diversity effect.

Microstrip: A microstrip is a microwave transmission line formed by a single conducting strip, and can be used to make a planar structure transmission line of a microwave integrated circuit. The microstrip features a small size, a light weight, applicability to a wide range of frequency bands, high reliability, low manufacturing costs, high conductivity, and good stability.

Figure 2:
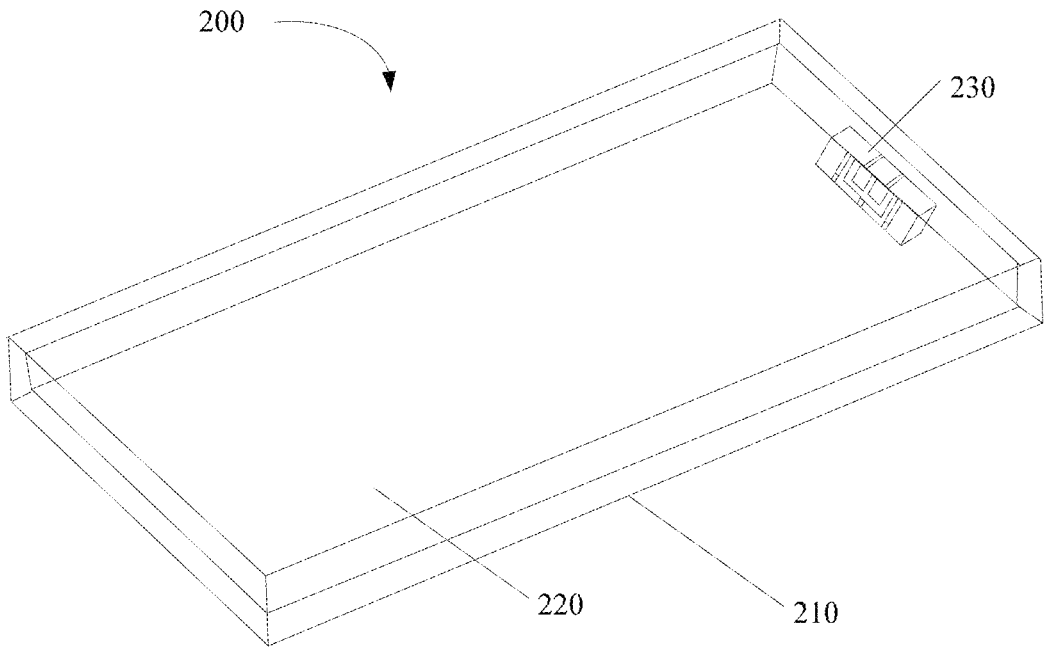
FIG. 2 is a schematic structural diagram of a mobile terminal according to an embodiment of this application.
Figure 3:
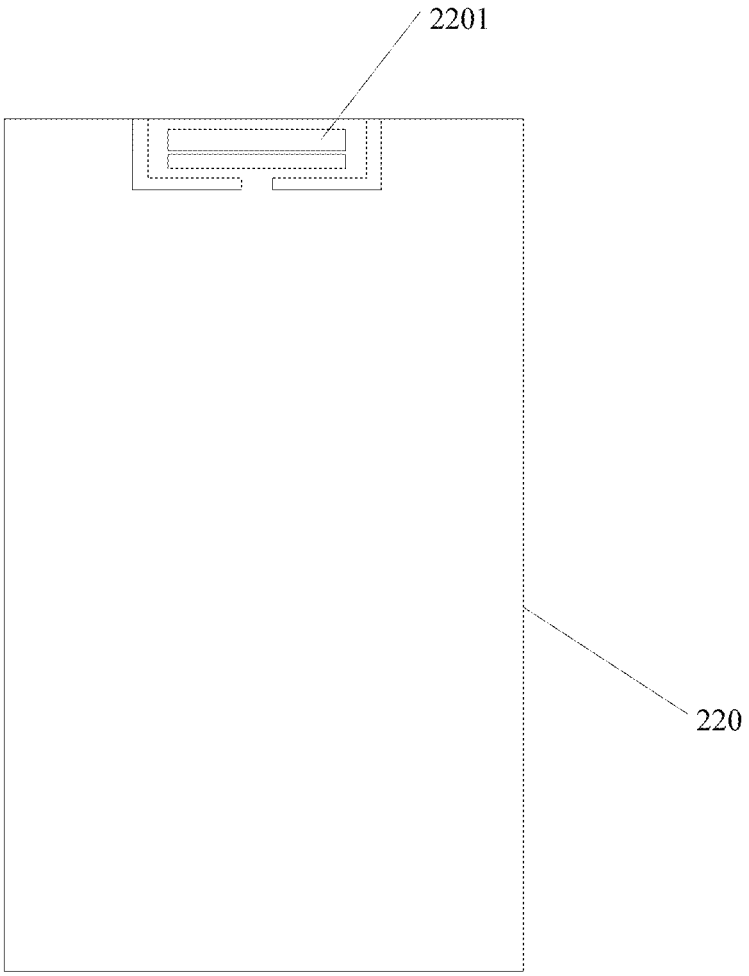
FIG. 3 is a schematic structural diagram of a ground plate according to an embodiment of this application.

Embodiments of this application provide an antenna. The antenna can reduce a coupling effect between radiating elements, and fully uses a clearance area of a ground plate to reduce an antenna size. The antenna may be applied to a mobile terminal, and the mobile terminal may be a mobile phone, a notebook computer, or a tablet computer. Referring to FIG. 2, the mobile terminal 200 includes a housing 210. A dielectric substrate and an antenna 230 are disposed in the housing 210, and a face of the dielectric substrate is a ground plate 220. Refer to FIG. 3 for understanding. FIG. 3 is a schematic diagram of a ground plate. The ground plate 220 includes a clearance area 2201, the clearance area 2201 is located at one end of the dielectric substrate, and the dielectric substrate includes a top end, a bottom end, a left end, and a right end. Preferably, the clearance area 2201 is located at the top end and the bottom end of the dielectric substrate. The clearance area 2201 is formed by hollowing out ground of the ground plate 220. The antenna 230 is disposed in the clearance area 2201. Certainly, though not shown in FIG. 2, the mobile terminal further includes a processor, a transceiver, a display module, an input/output module, or another electronic element. The antenna 230 is connected to the transceiver. The ground plate 220 and the antenna 230 are located in a top or bottom area of the mobile phone. A width of the clearance area in the ground plate is 5 mm, and a length of the antenna is 19.48 mm. An entire MIMO antenna has a compact layout, meeting a miniaturized MIMO antenna design requirement of a smartphone.

The following describes in detail an antenna provided in an embodiment of this application. An embodiment of an antenna in the embodiments of this application is as follows.

Figure 4:
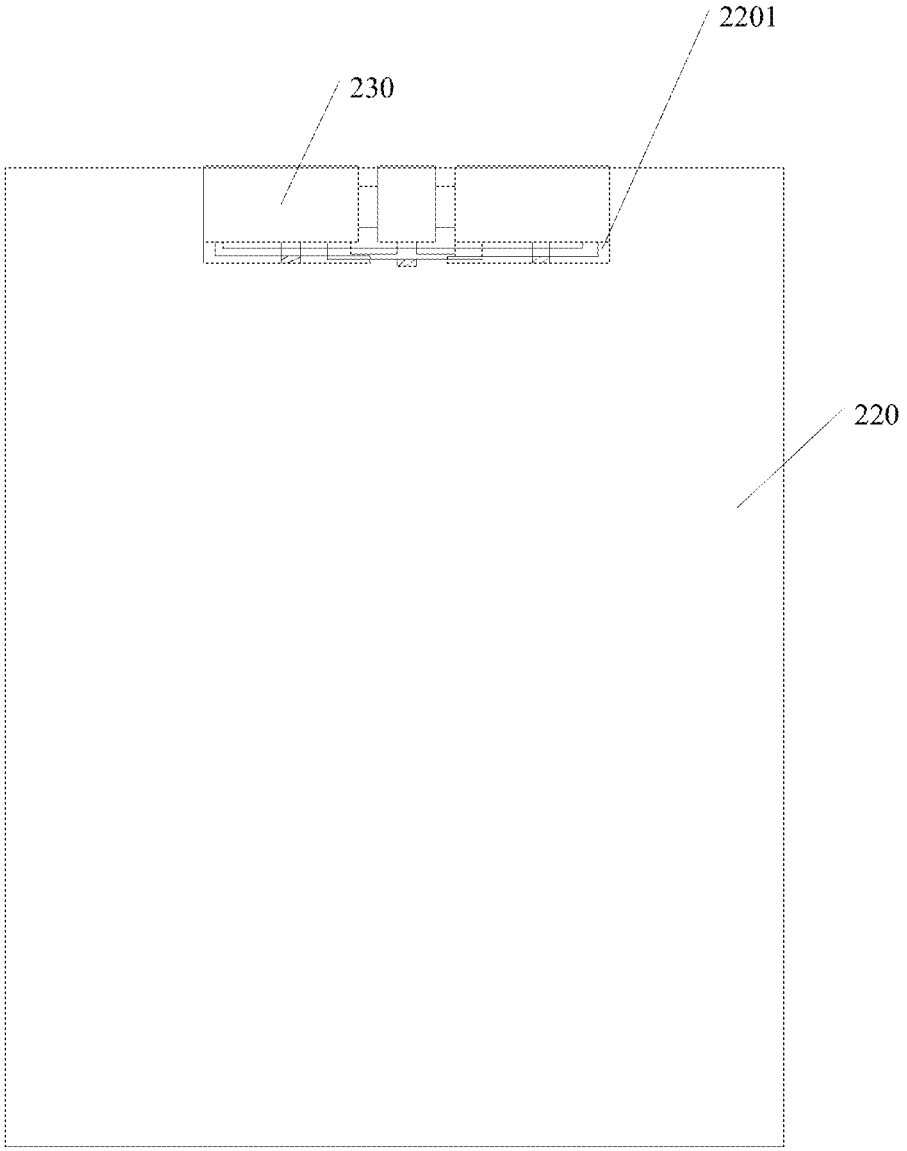
FIG. 4 is a schematic diagram of an antenna structure according to an embodiment of this application.
Figure 5:
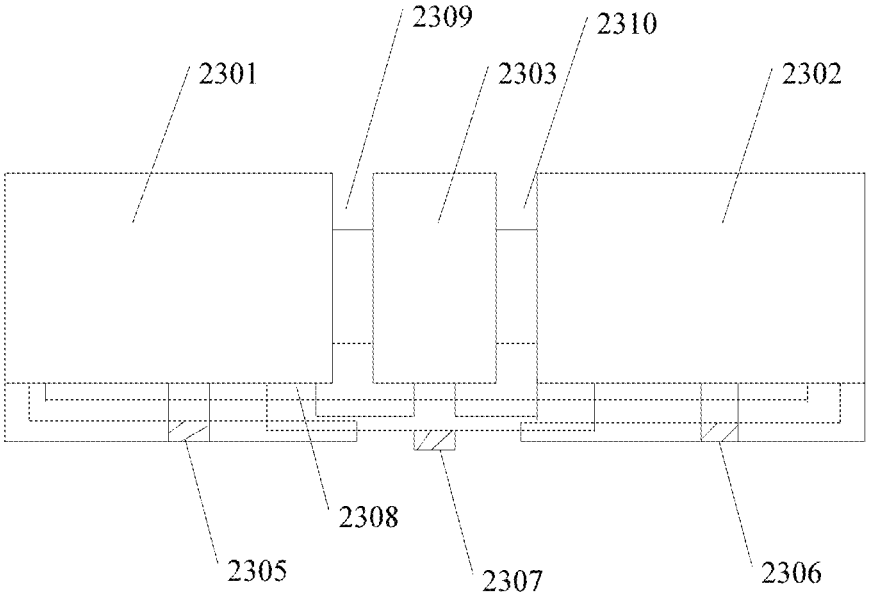
FIG. 5 is an enlarged schematic diagram of an antenna structure according to an embodiment of this application.
Figure 6:
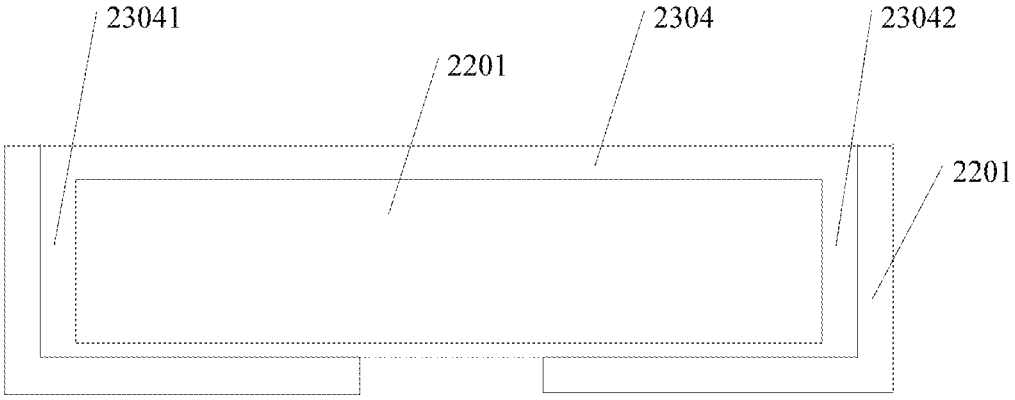
FIG. 6 is a schematic diagram of a clearance area according to an embodiment of this application.

Refer to FIG. 4 to FIG. 6 for understanding. FIG. 4 is a schematic structural diagram of an antenna, FIG. 5 is an enlarged schematic diagram of an antenna structure, and FIG. 6 is a schematic diagram of a clearance area. The antenna 230 includes three radiating elements and a closed ring 2304. The closed ring 2304 is disposed in the clearance area 2201 of the ground plate, and is connected to the ground plate. The clearance area 2201 may be of a rectangular shape. The closed ring 2304 may be a closed ring 2304 reserved when the clearance area 2201 is formed by hollowing out ground in the ground plate, or may be a closed ring 2304 disposed in the clearance area after the clearance area is formed by hollowing out ground in the ground plate. A specific manner for forming the closed ring 2304 is not limited in this application.

The three radiating elements are a first radiating element 2301, a third radiating element 2303, and a second radiating element 2302, respectively. The first radiating element 2301, the second radiating element 2302, and the third radiating element 2303 are connected using a microstrip 2308, to form a radiator. The third radiating element 2303 is disposed between the first radiating element 2301 and the second radiating element 2302. The three radiating elements are connected to three different feed points, respectively, and the radiator is excited using the three feed points. The first radiating element 2301 is connected to a first feed point 2305, the second radiating element 2302 is connected to a second feed point 2306, and the third radiating element 2303 is connected to a third feed point 2307.

Refer to FIG. 6 for understanding. The closed ring 2304 may be of a rectangular shape, and specifically, may be of a "□", "⊓", "⊓", or "⊢" shape. The closed ring 2304 may be of a regular shape, for example, a rectangular shape, or may be of an irregular shape. In actual application, the closed ring 2304 is of a closed structure, and need to have two corresponding sides, where the two sides form a symmetric structure. A specific shape is not limited in this application. In figures in this embodiment of this application, a "□" and "⊓" shapes are used as examples for description. For example, the closed ring 2304 of a "⊟" shape includes a left vertical side and a right vertical side that are symmetric, upper and lower horizontal sides, and a middle horizontal side. The two symmetric vertical sides are a first side 23041 and a second side 23042, respectively.

The first radiating element is 2301 disposed on the first side 23041 of the closed ring 2304, the second radiating element 2302 is disposed on a second side 23042 of the closed ring 2304, and the second side 23042 is a symmetrical side of the first side 23041. It can be understood that the first side 23041 may be a left side of the closed ring 2304 of a "⊔" shape, and the second side 23042 may be a right side of the closed ring 2304 a "⊟" shape.

Two sides of the closed ring 2304 participate in radiation of the first radiating element 2301 and the second radiating element 2302. To be specific, the first side 23041 participates in radiation of the first radiating element 2301, the second side 23042 participates in radiation of the second radiating element 2302, a main radiation direction of the first radiating element 2301 is a first direction, a main radiation direction of the second radiating element 2302 is a second direction, and the first direction is opposite to the second direction. For example, the main radiation direction of the first radiating element 2301 is to the left, while the main radiation direction of the second radiating element 2302 is to the right. In addition, the closed ring 230 is connected to the ground plate, to neutralize a ground current of the first radiating element 2301 and a ground current of the second radiating element 2302. The first radiating element 2301 and the second radiating element 2302 have good radiation pattern diversity, and a degree of coupling between the first radiating element 2301 and the second radiating element 2302 is relatively low.

A polarization manner of the first radiating element 2301 is the same as a polarization manner of the second radiating element 2302, a first preset distance 2309 is set between the first radiating element 2301 and the third radiating element 2303, and a second preset distance 2310 is set between the third radiating element 2303 and the second radiating element 2302. Optionally, the first preset distance 2309 is equal to the second preset distance 2310, and the first preset distance 2309 and the second preset distance 2310 may range from 0.1 mm to 3 mm.

Figure 7A:
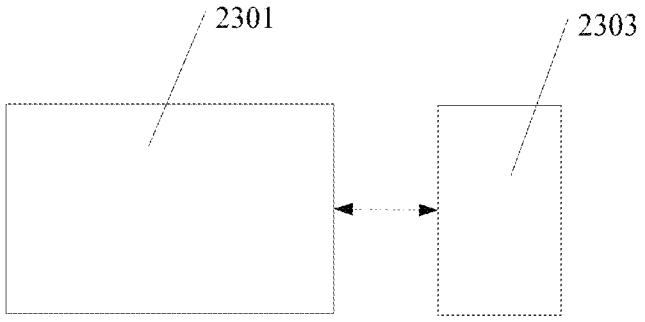
FIG. 7*a* is a schematic diagram of a preset distance when a first radiating element, a second radiating element, and a third radiating element are of a regular shape according to an embodiment of this application.
Figure 7B:
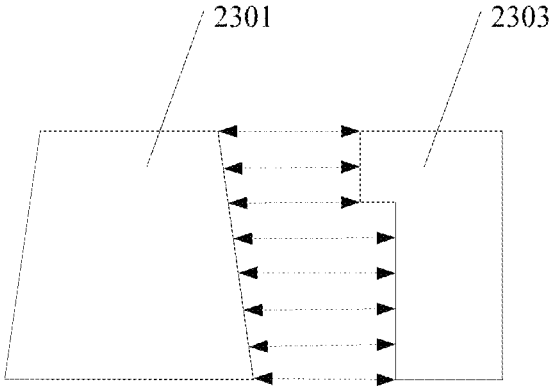
FIG. 7*b* is a schematic diagram of a preset distance when a first radiating element, a second radiating element, or a third radiating element is of an irregular shape according to an embodiment of this application.

It should be noted that, refer to FIG. 7*a* and FIG. 7*b*. FIG. 7*a* is a schematic diagram of a preset distance when the first radiating element, the second radiating element, and the third radiating element are of a regular shape. The first preset distance 2309 is a distance between a right side of the first radiating element 2301 (a side close to the third radiating element 2303) and a left side of the third radiating element 2303 (a side close to the first radiating element 2301). In actual application, if the first radiating element, the second radiating element, and the third radiating element are of an irregular shape, refer to FIG. 7*b* for understanding. Shapes of the first radiating element 2301 and the second radiating element 2302 in FIG. 7*b* are only examples for description, and do not constitute a limitation on a specific shape of the radiating element. The first preset distance is an average value of a plurality of line segments from a sampling point on a right side of the first radiating element 2301 to a left side of the third radiating element 2303. The plurality of line segments are all parallel to the ground plate, and distances between the plurality of line segments are the same, that is, vertical distances of intervals between all sampling points are the same. The foregoing describes the first preset distance, and a principle for the second preset distance is the same as a principle for the first preset distance. Repeated content is not described herein.

There is the first preset distance 2309 between the third radiating element 2303 and the first radiating element 2301, there is the second preset distance 2310 between the third radiating element 2303 and the second radiating element 2302, and the first preset distance 2309 and the second preset distance 2310 are used to participate in radiation of the third radiating element 2303, thereby ensuring that a polarization manner of the third radiating element 2303 is orthogonal to polarization manners of the first radiating element 2301 and the second radiating element 2302. Therefore, degrees of coupling between the third radiating element 2303 and the first radiating element 2301 and between the third radiating element 2303 and the second radiating element 2302 are reduced, and isolation between the third radiating element 2303 and first radiating element 2301 and between the third radiating element 2303 and the second radiating element 2302 is improved.

Because the first side 23041 of the closed ring 2304 participates in radiation of the first radiating element 2301, the second side 23042 participates in radiation of the second radiating element 2302, the first side 23041 extends a radiation bandwidth of the first radiating element 2301, and the second side 23042 extends a radiation bandwidth of the second radiating element 2302. However, the closed ring 2304 does not participate in the radiation of the third radiating element 2303. Therefore, a bandwidth of the third radiating element 2303 is narrower than bandwidths of the first radiating element 2301 and the second radiating element 2302. For example, the bandwidths of the first radiating element 2301 and the second radiating element 2302 are 3.4 GHz to 4.4 GHz, and the bandwidth of the third radiating element 2303 is 3.5 GHz to 3.75 GHz.

In one embodiment, because different operating bands are allocated to various wireless communication systems, to ensure that a communications device can operate in a plurality of systems, an operating band of the antenna needs to cover these frequency bands, and the antenna occupies as small space as possible. In this embodiment of this application, the radiation band of the third radiating element 2303 can be adjusted using an adjustable network. The adjustable network is a circuit structure formed by an adjustable inductor or capacitor. For example, the circuit structure is of a T shape, a π shape, or an L shape. A specific shape of the circuit structure in actual application is not limited in this application. An adjustment range of the frequency band of the third radiating element 2303 falls within a range of a frequency band of the first radiating element 2301 or the second radiating element 2302.

In one embodiment, a length of the antenna in this embodiment of this application is $$\frac{1}{4}\lambda, \text{ where } \lambda = \frac{v}{f_0},$$

v is a speed of light, and $f_0$ is a lowest frequency of a frequency band of the antenna.

Figure 8A:
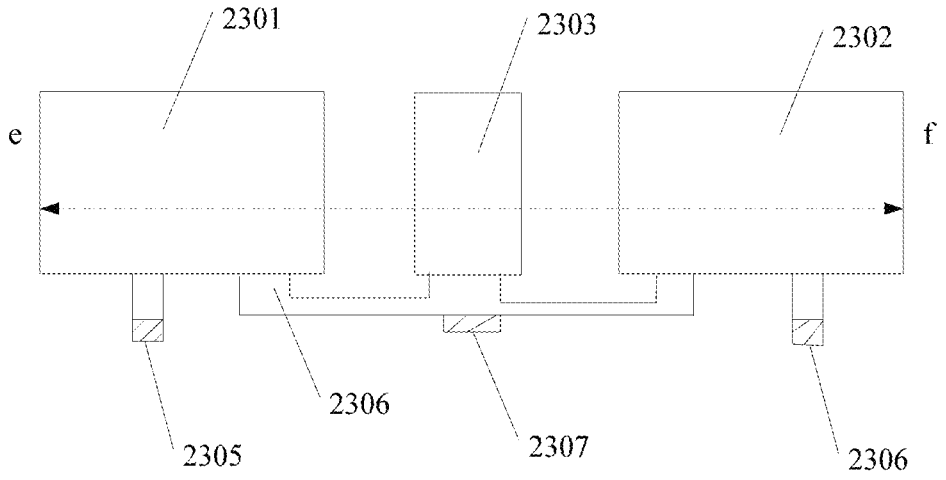
FIG. 8*a* is a schematic diagram of an antenna length when a first radiating element, a second radiating element, and a third radiating element are of a regular shape according to an embodiment of this application.
Figure 8B:
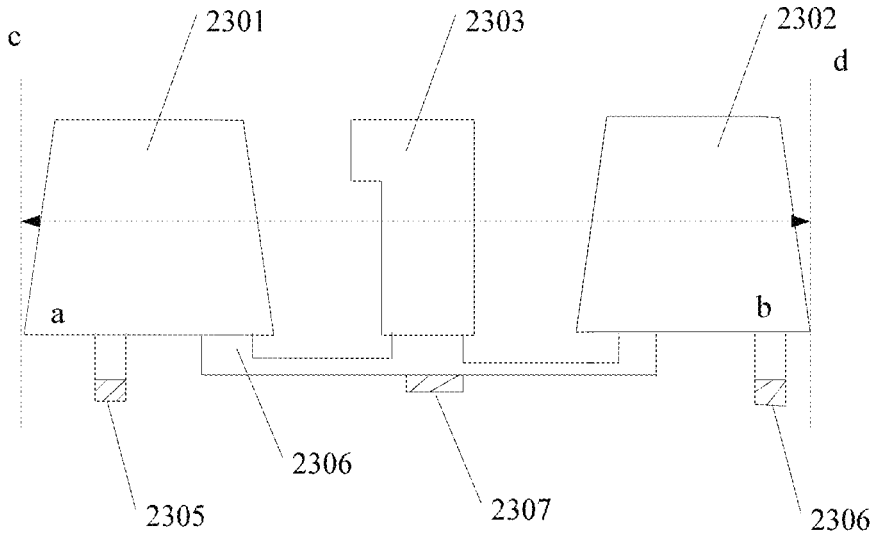
FIG. 8*b* is a schematic diagram of an antenna length when a first radiating element, a second radiating element, or a third radiating element is of an irregular shape according to an embodiment of this application.

For example, the lowest frequency of the operating band of the antenna is 3.85 GHz. In this case, the length of the antenna is 19.48 mm. It should be noted that, refer to FIG. 8*a* and FIG. 8*b* for understanding. FIG. 8*a* is a schematic diagram of an antenna length when the first radiating element 2301, the second radiating element 2302, and the third radiating element 2303 are of a regular shape. Referring to FIG. 8*a*, a distance between a leftmost side (a side e) of the first radiating element 2301 and a rightmost side (a side f) of the second radiating element 2302 is the length of the antenna. FIG. 8*b* is a schematic diagram of an antenna length when the first radiating element, the second radiating element, and the third radiating element are of an irregular shape. A perpendicular c passes through a leftmost point (a point a) of the first radiating element 2301, and a perpendicular d passes through a rightmost point (a point b) of the second radiating element 2302. A distance between the perpendicular c and the perpendicular d is the length of the antenna.

Figure 9:
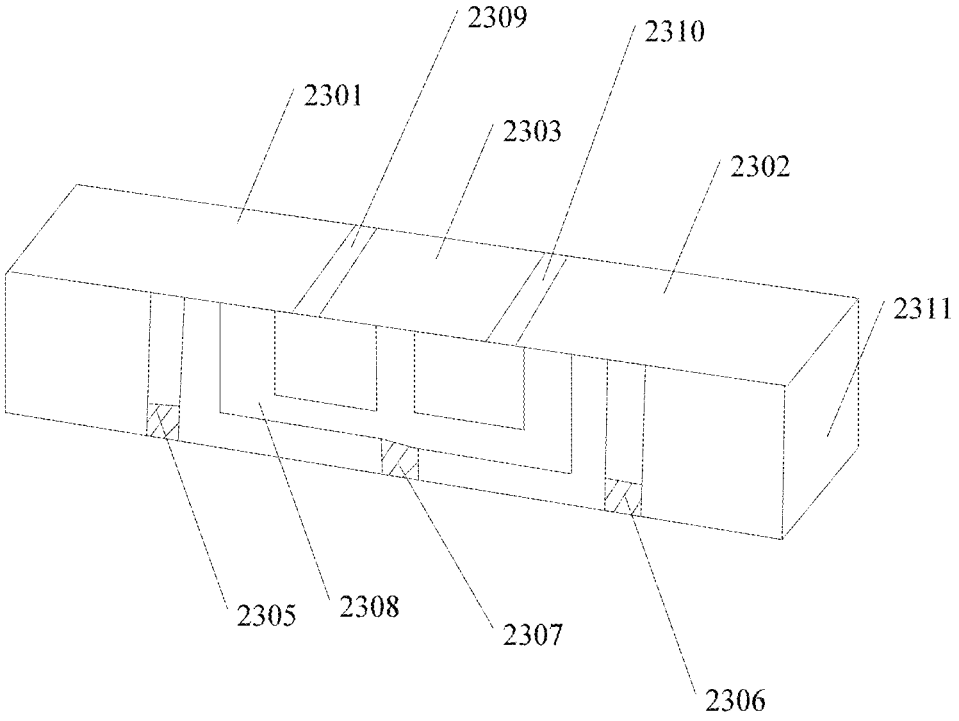
FIG. 9 is a three-dimensional schematic structural diagram of an antenna according to an embodiment of this application.

In one embodiment, FIG. 9 is a schematic structural diagram of an antenna according to another embodiment. The antenna further includes a support 2311. A first radiating element 2301, a second radiating element 2302, and a third radiating element 2303 are disposed on the support 2311, and the support 2311 is disposed on a ground plate. A shape of an upper plane of the support 2311 is the same as an overall shape of the three radiating elements, an area of the upper plane of the support 2311 is the same as an overall area of the three radiating elements, a shape of a lower plane of the support 2311 is the same as a shape of a clearance area, and an area of the lower plane of the support 2311 is the same as an area of the clearance area.

The foregoing describes a structure of the antenna, and the following analyzes antenna coupling in the embodiment based on antenna simulation performed using electromagnetic simulation software.

Figure 10:
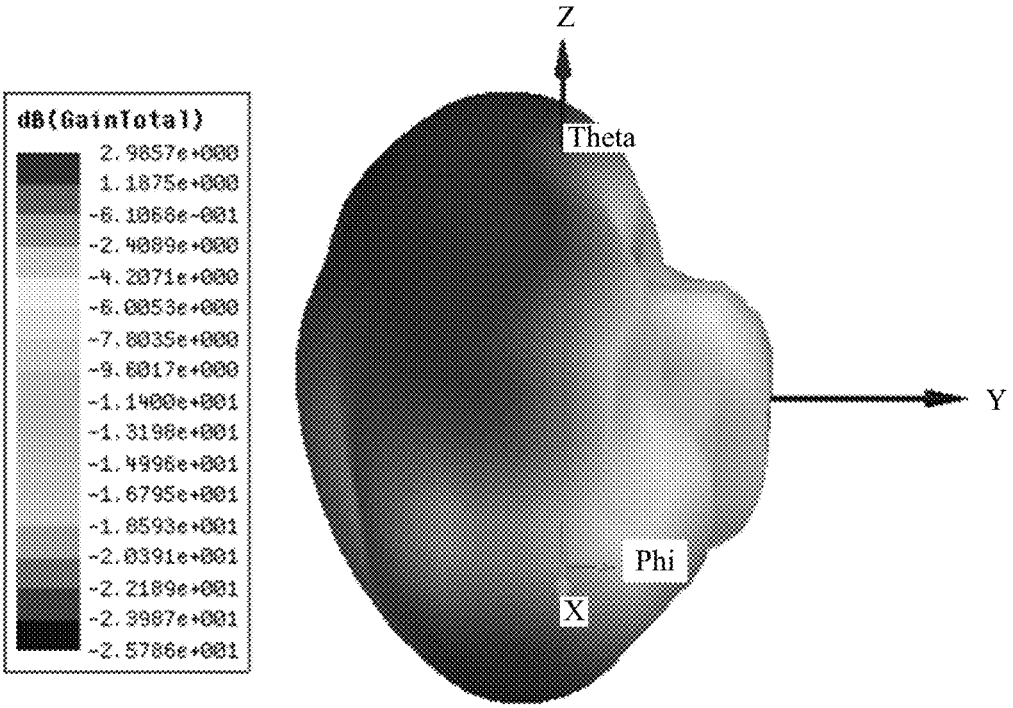
FIG. 10 is a diagram of a radiation direction of a first radiating element according to an embodiment of this application.
Figure 11:
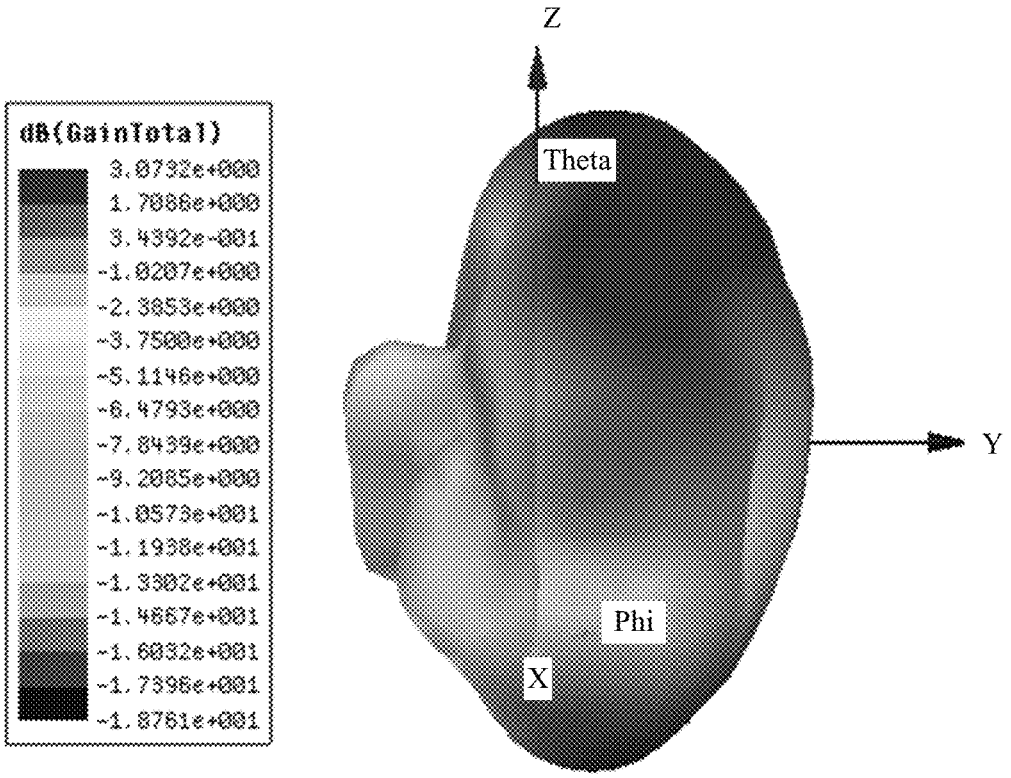
FIG. 11 is a diagram of a radiation direction of a second radiating element according to an embodiment of this application.

FIG. 10 is a diagram of a radiation direction of a first radiating element, and FIG. 11 is a diagram of a radiation direction of a second radiating element. The radiation direction of the first radiating element is opposite to the radiation direction of the second radiating element. The antenna operates at 3.6 GHz. It can be seen from the radiation pattern of the first radiating element and the radiation pattern of the second radiating element that good radiation pattern diversity is maintained between the first radiating element and the second radiating element, so that coupling between the antenna elements is reduced, and isolation between the antenna elements is improved.

Coupling of each radiating element is analyzed using a scattering parameter (scattering parameter, S parameter) method.

Figure 12:
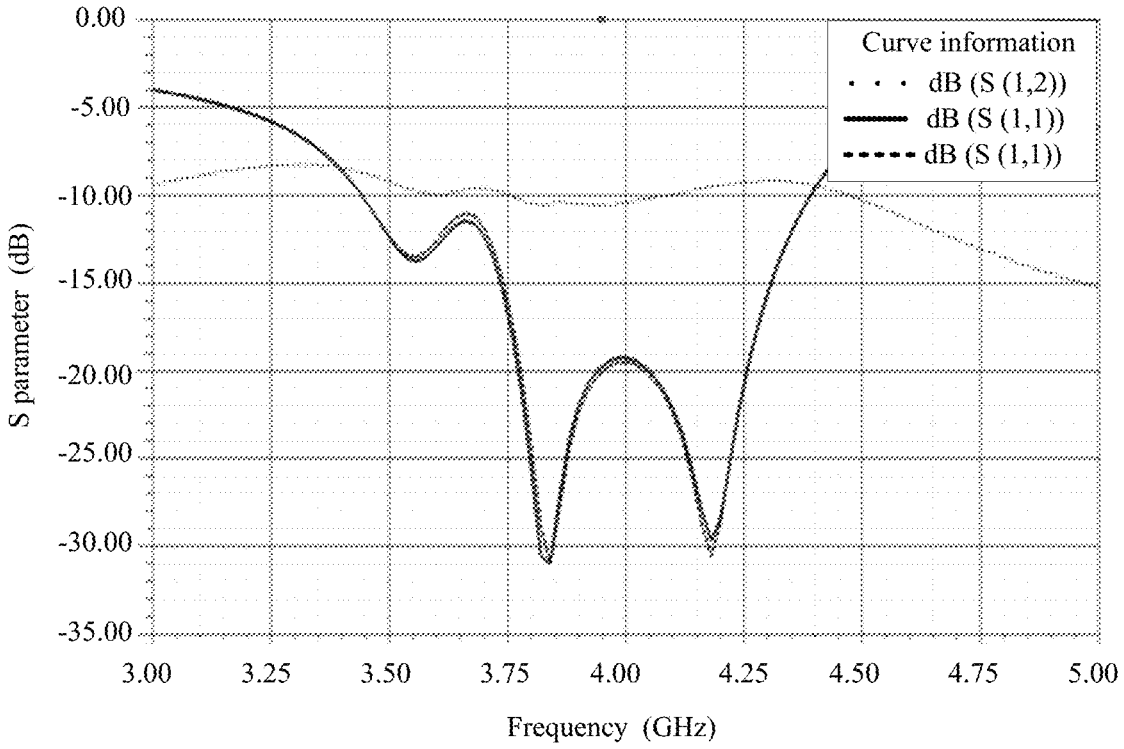
FIG. 12 is a diagram of scattering parameters of a first radiating element and a second radiating element according to an embodiment of this application.
Figure 13:
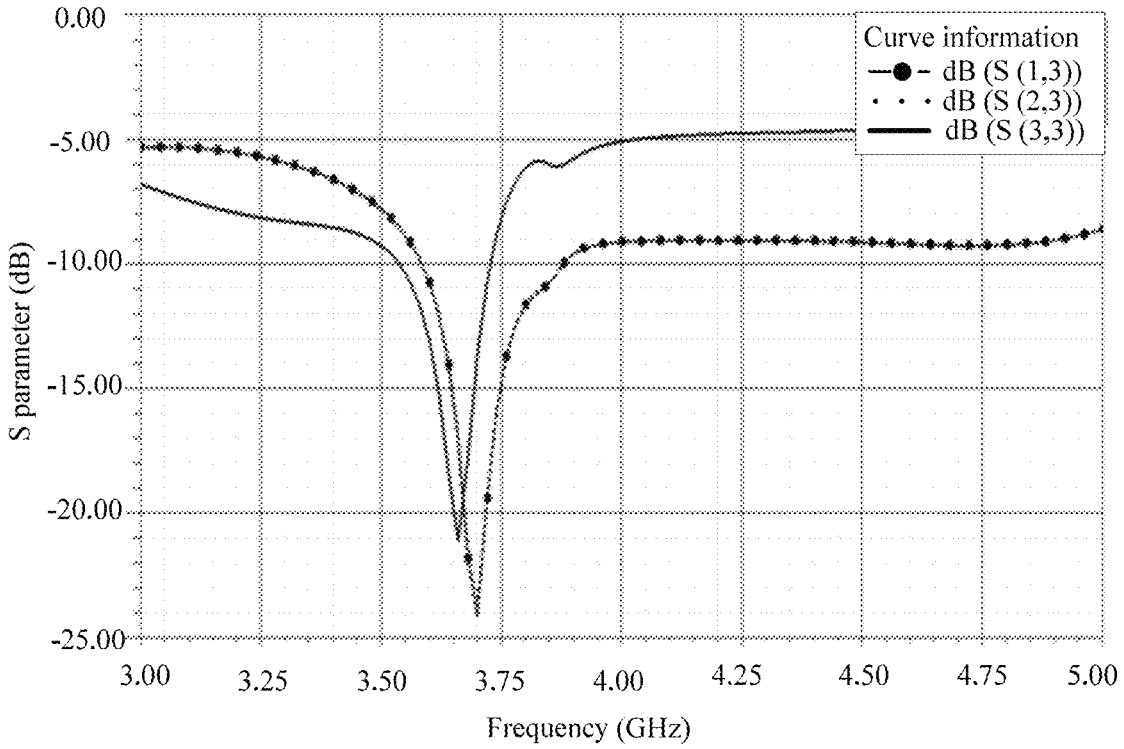
FIG. 13 is a diagram of scattering parameters of a third radiating element according to an embodiment of this application.

FIG. 12 shows S parameters of the first radiating element and the second radiating element. It can be learned from the figures that a bandwidth between the first radiating element and the second radiating element is 3.4 GHz to 4.4 GHz, and isolation is basically maintained to be 10 dB. FIG. 13 shows that a bandwidth of the third radiating element is 3.5 GHz to 3.75 GHz. Good isolation is maintained between the third radiating element and the first radiating element and between the third radiating element and the second radiating element.

Certainly, coupling between radiating elements can also be analyzed in another manner, such as an impedance method or a complex vector directivity functional integration method.

Figure 14:
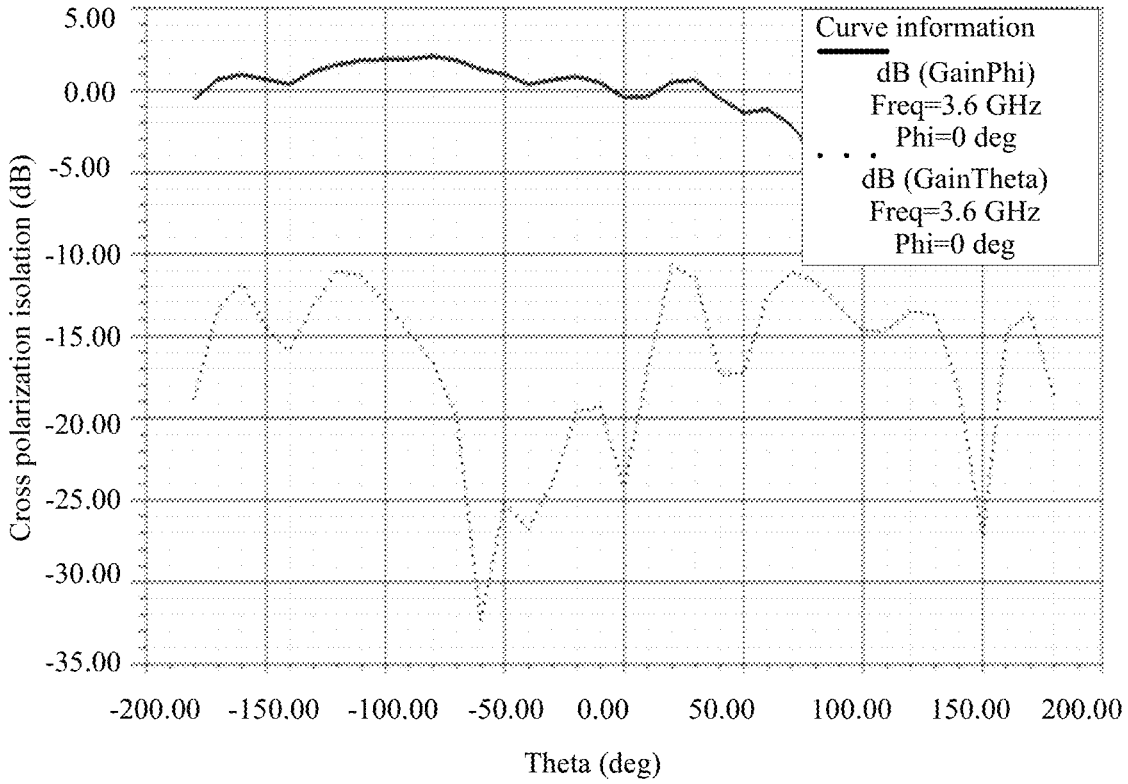
FIG. 14 is a diagram of a polarization manner of a first radiating element according to an embodiment of this application.
Figure 15:
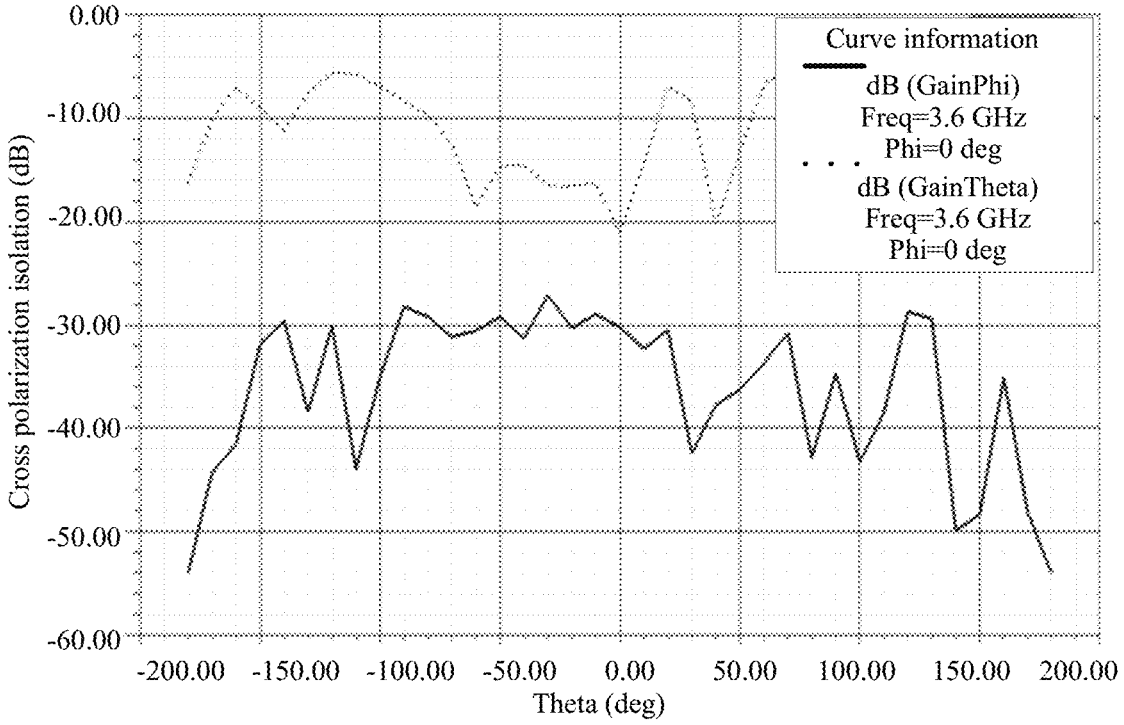
FIG. 15 is a diagram of a polarization manner of a third radiating element according to an embodiment of this application.

FIG. 14 is a schematic diagram of a polarization manner of a first radiating element, and FIG. 15 is a schematic diagram of a polarization manner of a third radiating element. It can be learned from FIG. 14 that a cross polarization gain (Gain) of the first radiating element is greater than 10 dB. In FIG. 14, Phi represents an XOY plane, Theta represents a plane perpendicular to the XOY plane, and a difference between a gain in a Phi direction (GainPhi) and a gain in a Theta direction (GainTheta) is cross polarization isolation. It can be learned from FIG. 15 that a cross polarization gain (the difference between GainTheta and GainPhi) of the third radiating element is greater than 10 dB. It can be learned that a polarization manner of the first radiating element is orthogonal to a polarization manner of the third radiating element, so that polarization diversity of the first radiating element, the second radiating element, and the third radiating element is used, and isolation between the radiating elements is improved.

In one embodiment, the first radiating element, the second radiating element, and the third radiating element are connected using the microstrip, so that the first radiating element, the second radiating element, and the third radiating element form one entity, and the first radiating element, the second radiating element, and the third radiating element are all disposed on the closed ring. Such an antenna design delivers a compact structure and makes full use of the clearance area of the ground plate. Two sides of the closed ring participate in radiation of the first radiating element and radiation of the second radiating element, respectively, the main radiation direction of the first radiating element is opposite to the main radiation direction of the second radiating element, and there is good radiation pattern diversity in the first radiation direction and the second radiation direction, reducing a degree of coupling between the first radiating element and the second radiating element. The first preset distance and the second preset distance participate in radiation of the third radiating element, so that the polarization manner of the third radiating element is orthogonal to the polarization manners of the first radiating element and the second radiating element, and the polarization diversity of the first radiating element, the second radiating element, and the third radiating element is used, to effectively improve isolation and reduce degrees of coupling between the third radiating element and the first radiating element and between the third radiating element and the second radiating element.

The first radiating element, the second radiating element, and the third radiating element.

The foregoing embodiments are merely intended for describing the technical solutions of this application, but not for limiting this application. Although this application is described in detail with reference to the foregoing embodiments, a person of ordinary skill in the art should understand that they may still make modifications to the technical solutions described in the foregoing embodiments or make equivalent replacements to some technical features thereof, without departing from the spirit and scope of the technical solutions of the embodiments of this application.

What is claimed is:

1. An antenna, comprising: a first radiating element, a second radiating element, a third radiating element, and a closed ring, wherein the first radiating element is connected to a first feed point, the second radiating element is connected to a second feed point, and the third radiating element is connected to a third feed point;

the closed ring is configured to be disposed in a clearance area of a ground plate, and configured to connect to the ground plate, wherein the clearance area is formed in a hollowed region of the ground plate; the first radiating element, the second radiating element, and the third radiating element are connected using a microstrip, to form a radiator, and the radiator is excited by the first feed point, the second feed point, and the third feed point;

the third radiating element is disposed between the first radiating element and the second radiating element;

the first radiating element is disposed on a first side of the closed ring, the second radiating element is disposed on a second side of the closed ring, and the second side is opposite to the first side; and a first preset distance is set between the first radiating element and the third radiating element, and a second preset distance is set between the third radiating element and the second radiating element.

2. The antenna according to claim 1, wherein the first preset distance is equal to the second preset distance.

3. The antenna according to claim 1, wherein a length of the antenna is $$\frac{1}{4}\lambda, \text{ wherein } \lambda = \frac{v}{f_0},$$

v is a speed of light, and $f_0$ is a lowest frequency of an operating band of the antenna.

4. The antenna according to claim 1, wherein a radiation band of the third radiating element is adjustable, and an adjustment range of a frequency band of the third radiating element falls within a range of a frequency band of the first radiating element or the second radiating element.

5. The antenna according to claim 1, wherein the closed ring is of a rectangular shape.

6. A mobile terminal, comprising:

a ground plate, a transceiver, and an antenna; wherein the antenna comprises a first radiating element, a second radiating element, a third radiating element, and a closed ring, wherein the first radiating element is connected to a first feed point, the second radiating element is connected to a second feed point, and the third radiating element is connected to a third feed point;

the closed ring is configured to be disposed in a clearance area of the ground plate, and configured to connect to the ground plate, wherein the clearance area is formed in a hollowed region of the ground plate; the first radiating element, the second radiating element, and the third radiating element are connected using a microstrip, to form a radiator; and the radiator is excited by the first feed point, the second feed point, and the third feed point;

the first radiating element is disposed on a first side of the closed ring, the second radiating element is disposed on a second side of the closed ring, and the second side is opposite to the first side;

a first preset distance is set between the first radiating element and the third radiating element, and a second preset distance is set between the third radiating element and the second radiating element; and the first feed point, the second feed point, and the third feed point are all connected to the transceiver.

7. The mobile terminal according to claim 6, wherein the first preset distance is equal to the second preset distance.

8. The mobile terminal according to claim 6, wherein a length of the antenna is $$\frac{1}{4}\lambda, \text{ wherein } \lambda = \frac{v}{f_0},$$

v is a speed of light, and $f_0$ is a lowest frequency of an operating band of the antenna.

9. The mobile terminal according to claim 6, wherein a radiation band of the third radiating element is adjustable, and an adjustment range of a frequency band of the third radiating element falls within a range of a frequency band of the first radiating element or the second radiating element.

10. The mobile terminal according to claim 6, wherein the closed ring is of a rectangular shape.

* * * * *